United States Patent [19]

Forsberg

[11] 4,028,226

[45] June 7, 1977

[54] METHOD OF REREFINING OIL WITH RECOVERY OF USEFUL ORGANIC ADDITIVES

[75] Inventor: John Wesley Forsberg, Mentor-On-The-Lake, Ohio

[73] Assignee: The Lubrizol Corporation, Cleveland, Ohio

[22] Filed: Nov. 12, 1975

[21] Appl. No.: 631,360

[52] U.S. Cl. ..... 208/180; 208/181

[51] Int. Cl.[2] ..... C10M 11/00

[58] Field of Search ..... 208/180, 181

[56] References Cited

UNITED STATES PATENTS

| | | | |
|---|---|---|---|
| 1,584,588 | 5/1926 | Acheson | 208/180 |
| 1,766,768 | 6/1930 | Werkenthin | 208/180 |
| 1,882,002 | 10/1932 | Dietrich | 208/180 |
| 1,990,359 | 2/1935 | Ambler | 208/180 |
| 2,294,461 | 9/1942 | Jones | 208/180 |
| 2,376,418 | 5/1945 | Clark et al. | 208/181 |
| 2,568,583 | 9/1951 | Graves | 208/180 |
| 3,763,036 | 10/1973 | Jordan et al. | 208/180 |
| 3,819,508 | 6/1974 | Fainman et al. | 208/181 |
| 3,835,035 | 9/1974 | Fainman et al. | 208/181 |

*Primary Examiner*—Delbert E. Gantz
*Assistant Examiner*—James W. Hellwege
*Attorney, Agent, or Firm*—James W. Adams, Jr.; William H. Pittman

[57] ABSTRACT

Used oil is rerefined by diluting it with a water-soluble polar diluent and removing insoluble impurities from the resulting solution, adding water to produce a two-phase system, separating the organic phase and removing the polar diluent therefrom. By this method, it is possible to recover oil which still contains viscosity modifying additives and the like. If desired, the rerefined oil can be subjected to further treatment such as hydrogenation.

9 Claims, No Drawings

METHOD OF REREFINING OIL WITH RECOVERY OF USEFUL ORGANIC ADDITIVES

This invention relates to a method of rerefining oil for use in lubricants and the like. More particularly, it relates to a method of recovering oil of lubricating viscosity from used oil which comprises the steps of:

A. Diluting said used oil with a water-soluble polar diluent in which said used oil is substantially soluble, and removing insoluble impurities from the solution of said oil in said polar diluent;

B. Removing a major amount of said polar diluent from the solution of step A by addition of water and removal of the resulting aqueous phase; and C. Removing the balance of said polar diluent from said oil.

It is well known that large quantities of petroleum-derived oil are used for the lubrication of machinery of many kinds, including internal combustion engines. Because of the current interest in conservation of petroleum, it is desirable to develop methods for rerefining or reconditioning used oil. Such reconditioning is usually required before reuse since the used oil almost always contains degradation products derived from the oil itself or from additives therein, as well as particles of metal, metal oxides and the like from the engine or other machinery.

Many rerefining methods involve unit operations such as distillation which aid in the removal of metal-containing additives and degradation products of additives. At the same time, however, additives are removed which may not be degraded and which, if present in the rerefined oil, would continue to provide the beneficial properties for which they were originally added. For example, many viscosity modifiers (e.g., viscosity index improvers) are not appreciably degraded during lubricant usage and could be retained in the rerefined oil to serve their original purpose.

A principal object of the present invention, therefore, is to provide a method for rerefining used oil to produce oil capable of further use as a lubricant, fuel or petrochemical intermediate or for similar purposes.

Another object is to provide a rerefining method which is relatively expensive and which can be used in the production of oil roughly comparable in properties to newly refined lubricating oil.

A further object is to provide a rerefining method which permits retention in the oil of viscosity modifiers and similar additives which are still capable of functioning.

Other objects will in part be obvious and will in part appear hereinafter.

The method of this invention is applicable to any used oil of lubricating viscosity. This includes used crankcase oil from motor vehicles (e.g., cars, trucks, locomotives), automatic transmission fluids and other functional fluids in which the major constituent is an oil of lubricating viscosity, and waste oil from industrial lubrication applications. It may be used with synthetic oils, including synthetic hydrocarbons, halo-substituted hydrocarbons, alkylene oxide polymers and interpolymers and derivatives thereof, ester- or silicon-based oils, and the like. However, its principal utility is with petroleum-based hydrocarbon oils. In the remainder of this specification, the oils referred to will be petroleum-based oils (i.e., mineral oils), but it is to be understood that synthetic oils of the above and similar types may be substituted therefor.

In step A of the method of this invention, the used oil is diluted with a polar diluent which is both soluble in water and a solvent for the oil. Suitable diluents are organic liquids which are substantially inert to the oil and are volatile enough for easy removal by vacuum stripping or the like. For the latter purpose, the diluent will usually have a boiling point at atmospheric pressure no higher than about 150° C. Examples of suitable diluents are lower alkanols such as methanol, 2-propanol and 1-butanol, and lower alkanones such as methyl ethyl ketone. Mixtures of these diluents may also be used. Preferred diluents are 1-butanol and mixtures of methanol and 1-butanol, typically comprising about 75–95% (by weight) 1-butanol with the balance being methanol. The ratio of diluent to oil is chosen so as to provide optimum separation of insoluble impurities and is typically between about 1:1 and 10:1 , by weight, with ratios between about 1.2:1 and 3:1 being preferred.

Insoluble impurities are removed from the oil-diluent mixture by methods know per se, such as decantation, centrifugation or filtration, the latter two methods being preferred. The dilution and separation of impurities are ordinarily carried out at temperatures of about 10°–50° C., typically at ambient temperature.

Step B of the method of this invention is the addition of water to the solution of step A so as to dissolve and remove the polar diluent. The water may contain, dissolved therein, a minor amount (typically about 1% by weight) of a sequestrant such as ethylenediaminetetraacetic acid or a salt thereof. It is preferably substantially neutral; i.e., it preferably has a pH of about 6–8.

The amount of water added is usually small, typically about 1 part per 20–100 parts of the solution of step A. Addition of less water than the minimum of this range usually causes no phase separation, while amounts of water greater than the maximum may result in recovery of an oil phase too low in viscosity index to be of use as a lubricant without the further addition viscosity modifiers. (It may, however, still be useful as bunker fuel or as a petrochemical intermediate.) Within the range, greater amounts of water usually yield an oil phase of higher yield but lower viscosity index and the amount of water may thus be varied so as to strike the desired balance between yield and viscosity index.

Upon addition of water and after agitation of the mixture, separation into two phases occurs. The aqueous phase, which is usually the top layer, generally comprises chiefly water and the diluent of step A, but it may contain a minor proportion of oil. The hydrophobic phase, generally the bottom layer, usually contains the major amount of purified oil in combination with some of the diluent of step A and non-polar, oil-soluble impurities such as any fuel which may be dissolved in the oil. The two phases are readily separated and the phase containing the major amount of oil is then subjected to step C.

In step C, the balance of the polar diluent from step A is removed from the oil. This is ordinarily done by vacuum stripping at relatively low temperatures, preferably no higher than about 125° C. During such vacuum stripping or other removal process, volatiles such as fuel dissolved in the oil will also be removed and may be recovered for subsequent use.

The product of step C is oil of lubricating viscosity which has been purified of most of the metallic and other additive ingredients and other impurities resulting from use. It still contains, however, viscosity index improvers and similar organic additives which impart beneficial properties thereto. Thus, it may be reused as a lubricant, or alternatively as a petrochemical intermediate, bunker fuel or the like. The term "of lubricating viscosity" as applied to said oil does not limit its utility to lubricating, but is merely a description of a property thereof.

The product of step C is sometimes darkly colored and if so, it may be subjected to other treatment steps such as hydrogenation, solvent extraction, treatment with clay or the like.

As previously noted, the aqueous phase from step B may also contain a small amount of oil. This oil can be recovered (e.g., by vacuum stripping optionally followed by distillation) and used as bunker fuel, petrochemical intermediate or the like. Because of the absence or relatively low content of viscosity index improver therein, the oil from the diluent phase will usually not be suitable for repeated lubricant use.

The method of this invention is illustrated by the following examples. All parts are by weight.

EXAMPLE 1

Two thousand parts of a used lubricating oil is dissolved in 3700 parts of 1-butanol and insolubles are removed from the solution by means of a DeLaval clarifier. Separate portions of the clarified solution (1700 parts each) are stirred with water and allowed to separate into two phases. The lower phase in each instance is removed and stripped at 100° C./10 torr. The weight of the oil thus recovered and the viscosity index thereof are measured. The upper layer is also stripped under vacuum and the oil recovered therefrom. The results are given in Table I.

TABLE I

| Parts by weight | | | |
|---|---|---|---|
| Water | Oil in top phase | Oil in bottom phase | Viscosity index of bottom phase |
| 50 | 277 | 291 | 143 |
| 30 | 370 | 208 | 150 |
| 20 | 474 | 82 | 164 |

EXAMPLE 2

The procedure of Example 1 is repeated, using a solution of 2000 parts of oil in 2700 parts of 1-butanol. The results are given in Table II.

TABLE II

| Parts by weight | | | |
|---|---|---|---|
| Water | Oil in top phase | Oil in bottom phase | Viscosity index of bottom phase |
| 50 | 173 | 321 | 140 |

TABLE II-continued

| Parts by weight | | | |
|---|---|---|---|
| Water | Oil in top phase | Oil in bottom phase | Viscosity index of bottom phase |
| 30 | 221 | 274 | 145 |
| 20 | 286 | 206 | 155 |

EXAMPLE 3

The procedure of Example 1 is repeated, using a solution of 1000 parts of oil in 2350 parts of 1-butanol. The results are given in Table III.

TABLE III

| Parts by weight | | | |
|---|---|---|---|
| Water | Oil in top phase | Oil in bottom phase | Viscosity index of bottom phase |
| 75 | 199 | 282 | 153 |
| 50 | 283 | 199 | 152 |
| 30 | 343 | 181 | 162 |
| 20 | 389 | 92 | 172 |

What is claimed is:

1. A method of recovering oil of lubricating viscosity from used oil of lubricating viscosity which comprises the steps of:

A. Diluting said used oil with a water-soluble polar diluent in which said used oil is substantially soluble, said diluent comprising a lower alkanol or lower alkanone, and removing impurities insoluble in the soluble in the solution of said oil in said polar diluent from said solution;

B. Removing a major amount of said polar diluent for the solution of step A by addition of water having a pH of about 6–8 and removal of the resulting aqueous phase; and

C. Removing the balance of said polar diluent from said oil.

2. A method according to claim 1 wherein the water used in step B is substantially neutral.

3. A method according to claim 2 wherein insoluble impurities are removed in step A by centrifugation or filtration.

4. A method according to claim 3 wherein the polar diluent in step A is 1-butanol or a mixture of methanol and 1-butanol.

5. A method according to claim 3 wherein the polar diluent in step A is 1-butanol.

6. A method according to claim 2 wherein step C is effected by stripping volatile materials from the product of step B under vacuum.

7. A method according to claim 6 wherein the polar diluent in step A is 1-butanol or a mixture of methanol and 1-butanol.

8. A method according to claim 6 wherein the polar diluent in step A is 1-butanol.

9. A method according to claim 6 wherein the material removed by stripping includes a fraction recoverable as fuel.

* * * * *

UNITED STATES PATENT AND TRADEMARK OFFICE

CERTIFICATE OF CORRECTION

PATENT NO. : 4,028,226

DATED : June 7, 1977

INVENTOR(S) : John Wesley Forsberg

It is certified that error appears in the above-identified patent and that said Letters Patent are hereby corrected as shown below:

Column 2, line 23, "know" should read --known--.
Column 4, line 32, "in the soluble" should be cancelled; line 34, "for" should read --from--; lines 36-37, the words in bold-face type should appear in ordinary type.

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*